US005865929A

United States Patent [19]

Sing

[11] Patent Number: 5,865,929

[45] Date of Patent: Feb. 2, 1999

[54] METHOD OF PRODUCING LAMINATED WOOD BEAMS

[76] Inventor: Peter Sing, P.O. Box 11532, Winslow, Wash. 98110

[21] Appl. No.: 673,144

[22] Filed: Jul. 1, 1996

Related U.S. Application Data

[63] Continuation-in-part of Ser. No. 493,011, Jun. 21, 1995, Pat. No. 5,618,371.

[51] Int. Cl.[6] ..... B27M 1/08

[52] U.S. Cl. ..... 156/264; 156/260; 52/731.1; 52/233; 144/345; 144/378

[58] Field of Search ..... 156/264, 260, 156/259, 257, 268; 144/344, 345, 346, 350, 351, 353, 354, 359, 363, 367, 368, 371, 376, 378; 52/233, 745.19, 730.1, 730.7, 731.1, 731.3, 731.4, 731.5

*Primary Examiner*—David A. Simmons
*Assistant Examiner*—Linda L. Gray
*Attorney, Agent, or Firm*—Nathaniel Altman

[57] ABSTRACT

A plurality of conventional wood planks are vertically stacked and adhesively joined into an aligned symmetrical pile, the top and bottom planks being wider than planks, therebetween. A longitudinal bisecting cut through the pile produces two asymmetric sections, mirror-images of each other, which, when reversed, have the projecting edges of the top and bottom planks facing each other. By joining these projecting edges adhesively, the laminated hollow wood beam is assembled. Provision is made for adding internal bracing for increased strength and for covering the open ends of the hollow beam.

4 Claims, 1 Drawing Sheet

FIG. 1
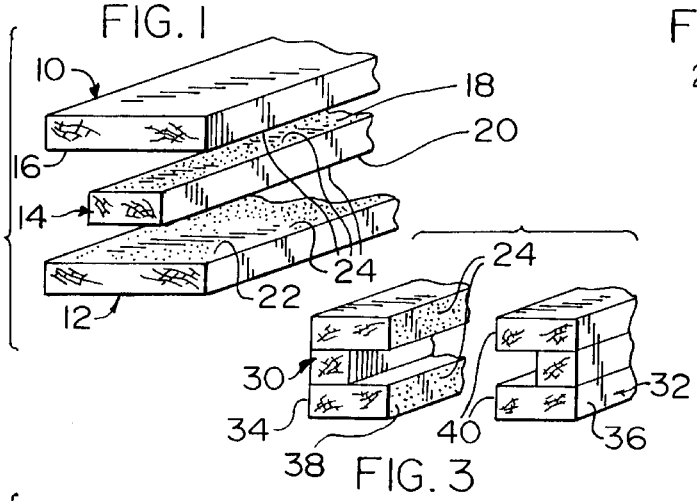
FIG. 2
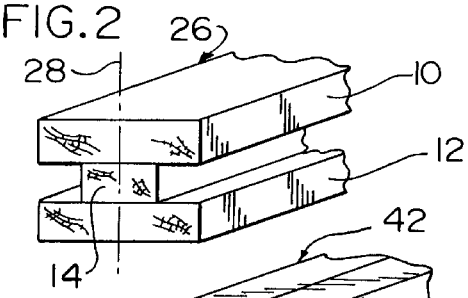
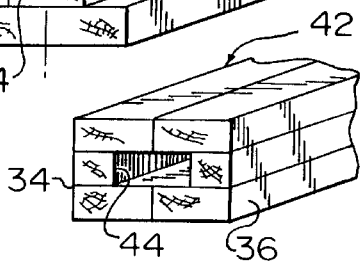
FIG. 3
FIG. 4
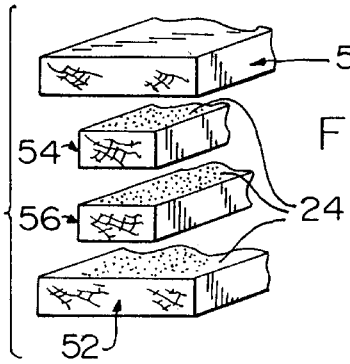
FIG. 5
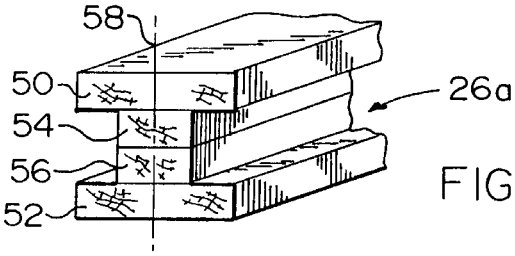
FIG. 6
FIG. 7
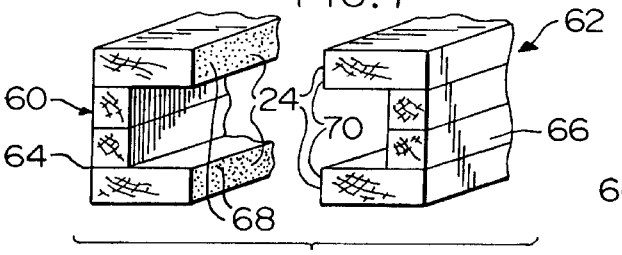
FIG. 8
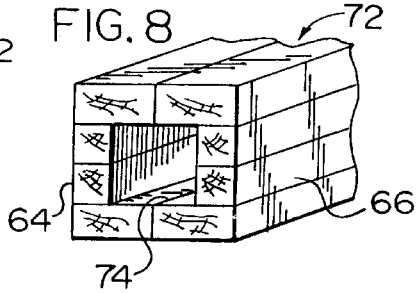
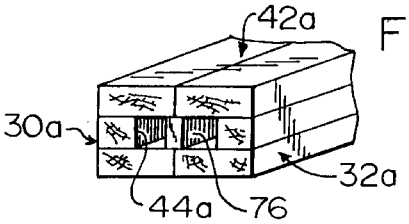
FIG. 9
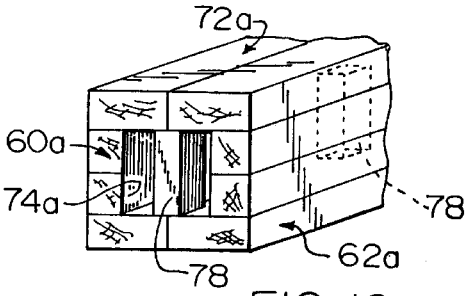
FIG. 10
FIG. 11
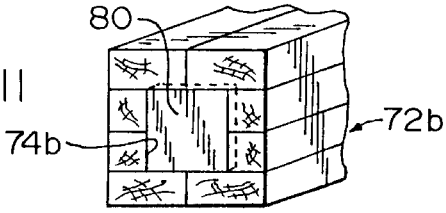

METHOD OF PRODUCING LAMINATED WOOD BEAMS

This application is a continuation-in-part of U.S. application Ser. No. 08/493,011 filed Jun. 21, 1993, now U.S. Pat. No. 5,618,371.

FIELD OF THE INVENTION

This invention is directed to the production of laminated space-containing structural wood beams, with conventional wood planks cut from logs as the starting material.

BACKGROUND OF THE INVENTION

In contrast to issued U.S. Pat. No. 5,618,371, this application discloses and claims subject matter not previously considered, taught or claimed in the parent application, which uses less-than-perfect half-logs or planks together with spacers to produce its space-containing laminated wood beams. In contrast, the method of the present invention, using top and bottom planks with undamaged edges in the lamination, requires no spacer, and the principal object is to provide a laminated hollow wood beam of high quality, of great strength, light in weight, and highly resistant to warping, twisting or other deformation. Another object of the present invention is to provide a method of producing laminated hollow wood beams that is efficient, economical and able to produce a highly competitive and most useful structural wood product.

SUMMARY OF THE INVENTION

Two pre-cut equal-length planks having uniform longitudinal edges serve as the upper and lower layers in a laminated wood beam of this invention. One or more planks equal in length but narrower in width than the top and bottom planks are positioned therebetween, the to-be-joined surfaces are coated with adhesive, and the planks are assembled together into a laminated symmetrical stack, the end view of which resembles a capital I. A longitudinal cut along a vertical axis bisecting the laminated stack creates two asymmetric sections, shaped approximately like mirror-image brackets (] [); by reversing these two bracket-like sections so that the projecting top and bottom plank edges face each other, coating the projecting facing edges with adhesive and pressing the corresponding edges together until the adhesive has set, a laminated hollow wood beam of rectangular cross-section is formed. The proportions of the resultant beam are determined by the width of the top and bottom planks and the number and thickness of the narrower planks used therebetween.

Full details of the concepts, method and products of this invention and its preferred embodiments will be disclosed and described in connection with the accompanying illustrative drawings.

BRIEF DESCRIPTION OF DRAWINGS

FIG. 1 is an end perspective partial view of three pre-cut planks in position to be assembled in accordance with this invention;

FIG. 2 is an end perspective partial view of the planks of FIG. 1 assembled and in position to be longitudinally bisected;

FIG. 3 is an end perspective partial view of the two sections formed by the bisection of the FIG. 2 assembly now rearranged and positioned to be reassembled;

FIG. 4 is an end perspective partial view of a laminated hollow wood beam formed by the reassembly of the two sections of FIG. 3;

FIG. 5 is an end perspective partial view similar to FIG. 1 but with two intermediate narrower planks in position to be laminated to, and assembled with, top and bottom wider planks;

FIG. 6 is an end perspective partial view of the planks of FIG. 5 assembled and in position to be longitudinally bisected;

FIG. 7 is an end perspective partial view of the two sections formed by the bisection of the FIG. 6 assembly now rerarranged and in position to be reassembled;

FIG. 8 is an end perspective partial view of a laminated hollow wood beam formed by the reassembly of the sections of FIG. 7;

FIG. 9 is an end perspective partial view of the beam of FIG. 4 with an added supporting brace extending the length of the beam;

FIG. 10 is an end perspective partial view of the beam of FIG. 6 with a plurality of supporting braces added at intervals along the length of the beam; and FIG. 11 is an end perspective partial view of the beam of FIG. 6 with an added end-closing panel.

DESCRIPTION OF THE PREFERRED EMBODIMENTS

In FIG. 1, upper pre-cut wood plank 10 is shown superposed and in alignment with identical lower plank 12, while narrower plank 14 is aligned, centered and poised therebetween. Surface 16 of plank 10 facing surface 18 of plank 14, and surface 20 of plank 14 facing surface 22 of plank 12, are all selectively coated with adhesive 24, so that when the planks are joined together and adhesive 24 has set, the laminated symmetrical intermediate assembly 26 shown in FIG. 2 results. A longitudinal cut through intermediate assembly 26 along vertical axis 28 then bisects assembly 26 into two asymmetric mirror-image sections 30 and 32, which, when reversed in position as seen in FIG. 3, have their respective extending edges 38 and 40 facing each other; by now applying adhesive 24 to edges 38 and 40, and holding them alignedly together until adhesive 24 has set, sections 30 and 32 are now recombined and reassembled to form completed laminated hollow wood beam product 42 of FIG. 4, with space 44 extending longitudinally therethrough.

It should be noted that the optional step of smoothing surfaces 34 and 36 of sections 30 and 32, respectively, formed by the bisecting cut through intermediate assembly 26, may be performed by plane-milling or the like, either on sections 30 and 32 before their reassembly or on finished beam 42. It may also be noted that both the laminating step and the reassembly step may be carried out with the application of pressure, heat or both to enhance the bonding or to accelerate the setting of adhesive 24, depending on the type of adhesive used.

The embodiment of this invention shown in FIGS. 5–8 is completely analagous to that appearing in FIGS. 1–4 described above. In FIG. 5, upper pre-cut plank 50 is superposed and aligned with identical lower plank 52, with identical narrower planks 54 and 56 therebetween in position to be joined in a vertical symmetrical stack. Adhesive 24 is applied selectively to all surfaces of planks 50. 52, 54 and 56 which are to be joined and laminated into intermediate assembly 26*a* shown in FIG. 6; thereafter, when adhesive 24 is set, a longitudinal cut taken through vertical axis 58 shown in FIG. 6 bisects assembly 26*a* into the two asymmetric mirror-image sections 60 and 62, seen after cutting in reversed position in FIG. 7. Surface 64 of section 60 and surface 66 of section 62, formed by the cutting step, may be smoothed optionally at this point or after assembly of the laminated hollow beam 72 of FIG. 8. This assembly is accomplished by applying adhesive 24 to the facing projecting edges 68 of section 60 and 70 of section 62, alignedly joining respective edges 68, 70 and holding the assembly in position until adhesive 24 has set, thus producing laminated beam 72 with interior space 74 extending throughout its entire length.

FIG. 9 illustrates laminated beam 42*a*, similar to beam 42 of FIG. 4 in all respects except that wood strengthening brace 76 has been added. Brace 76 is centrally disposed in interior space 44*a* of beam 42*a* and extends vertically and longitudinally therethrough in supportive contact with, and adhesively joined to the upper and lower inner surfaces defining space 44*a*, which is substantially bisected thereby, The addition of brace 76 to beam 42*a* is most readily performed at the same time that the two asymmetric mirror-image sections 30*a* and 32*a* (cf 30,32 of FIG. 3) are joined together.

In FIG. 10, laminated hollow beam 72*a* is similar to beam 72 of FIG. 8 in all respects except for the plurality of strengthening braces 78 positioned at intervals along the length of beam 72*a* and extending vertically to be in supportive contact with and adhesively joined to the upper and lower inner surfaces defining space 74*a* of beam 72*a*. As in the case of brace 76 of FIG. 9, braces 78 are most easily introduced at the time sections 60*a* and 62*a* are being brought together.

Beam 72*b* of FIG. 11 has its interior space 74*b* closed off by wood or plywood facing panel 80 fittingly and adhesively mounted at the mouth of space 74*b*. Clearly, end plates (not shown) of these or other materials covering the entire end face of any of the laminated beams of this invention may be substituted for panel 80. It should be understood also that insertion of insulation, strengthening materials and conduits for transmission of utilities into the beams of this invention, as disclosed and claimed in the parent application, has not been shown in the drawings but is included among the concepts of the present invention.

The preferred embodiments of this invention and the best modes now contemplated for practicing it have been fully disclosed; it will, however, be obvious to those skilled in the art that modifications, substitutions, alterations and additions may be made without departing from the invention's concepts which are limited only by the scope of the ensuing claims:

What is claimed is:

1. A method of producing a laminated hollow wood beam using a plurality of equal-length pre-cut lumber planks cut from at least one log as starting material, which comprises the steps of:

a) applying adhesive selectively to areas of the surface of the lumber planks where said surfaces will contact each other when the pre-cut lumber planks are assembled;

b) positioning two identically-sized pre-cut lumber planks from a) so that one is spacedly superposed over the other, and placing between the two identically-sized planks at least one pre-cut lumber plank from a) which is equal in length to but narrower in width to the identically-sized planks so that the two identically-sized pre-cut lumber planks and the at least one lumber plank arranged in or therebetween are aligned, centered, and parallel relationship;

c) putting the surfaces, having the adhesive thereon together so that the two identically-sized planks and at least one plank therebetween are stacked into a symmetrical intermediate assembly;

d) causing the adhesive to set;

e) making a single longitudinal cut along an axis perpendicular to a horizontal surface of the assembly and thus bisecting the intermediate assembly into two asymmetric mirror-image sections, each of the sections having projecting edges and one cut side formed by the cutting step;

f) rearranging the two asymmetric mirror-image sections so that the projecting edges of the sections face each other;

g) applying adhesive to the projecting facing edges of the sections;

h) putting and holding the projecting facing edges, having the adhesive from g) thereon alignedly together; and i) causing the adhesive in h) to set sp to form the laminated wood beam.

2. The method of producing a laminated hollow wood beam as defined in claim 1, further comprising the step of smoothing the cut side of each section, the smoothing step being carried out at a time selected from the group consisting of between step e) and step f), and following step i).

3. The method of producing a laminated hollow wood beam as defined in claim 1, further comprising the step, simultaneous with step h) of inserting adhesively-end-coated bracing means to engage supportively inner surfaces of the two identically-sized planks, where the bracing means is centrally within the beam.

4. The method of producing a laminated hollow wood beam as defined in claim 3, wherein the bracing means is selected from the group consisting of a single wood support extending the length of the laminated beam and a plurality of spaced wood supports positioned at intervals along the length of the laminated beam.

* * * * *